US007000920B2

(12) United States Patent
Camp et al.

(10) Patent No.: US 7,000,920 B2
(45) Date of Patent: Feb. 21, 2006

(54) MEMORY ENGAGEMENT GAME

(76) Inventors: Cameron J. Camp, 7274 Hollyhock La., Solon, OH (US) 44139; John Cichello, 2722 Vinton Woods, Wooster, OH (US) 44691; Ronni S. Sterns, 680 N. Portage Path, Akron, OH (US) 44303; Anthony Sterns, 52 Hurlburt, Akron, OH (US) 44303

( * ) Notice: Subject to any disclaimer, the term of this patent is extended or adjusted under 35 U.S.C. 154(b) by 118 days.

(21) Appl. No.: 10/686,200

(22) Filed: Oct. 15, 2003

(65) Prior Publication Data

US 2005/0082754 A1 Apr. 21, 2005

(51) Int. Cl.
*A63F 3/06* (2006.01)

(52) U.S. Cl. ..... 273/273; 273/270; 273/429

(58) Field of Classification Search ..... 273/269, 273/270, 429, 430, 431, 432, 273, 309, 150; 434/343, 348, 349, 363
See application file for complete search history.

(56) References Cited

U.S. PATENT DOCUMENTS 3,048,403 A 8/1962 Bosque, Jr.
3,224,112 A * 12/1965 Hanson ..... 273/270
3,464,124 A * 9/1969 Lynd ..... 434/170
3,665,618 A * 5/1972 Hahn ..... 273/270
3,962,808 A 6/1976 Ryder et al.
3,970,312 A 7/1976 Senn
4,005,535 A 2/1977 Davis
4,244,577 A 1/1981 Poulos
4,291,882 A 9/1981 Del Monte
5,120,069 A * 6/1992 Shaw ..... 273/309
5,458,338 A * 10/1995 Beardsley ..... 273/269
5,743,740 A 4/1998 Visser et al.
5,868,389 A * 2/1999 Kalivas ..... 273/286
5,967,895 A * 10/1999 Kellen ..... 463/19
6,095,524 A * 8/2000 Richter et al. ..... 273/269
6,270,077 B1 8/2001 Cohen
6,702,581 B1 * 3/2004 Walker ..... 434/167

OTHER PUBLICATIONS

Camp, Cameron J. "Memory Interventions for Norman and Pathological Older Adults," Annual Review of Gerontology and Geriatrics. 155-189; vol. 18, 1988.
Orsulic-Jeras, Silvia et al. "Montessori-Based Demential Activities in Long-Term Care: Training and Implementation," Activities, Adaptation & Aging. 107-120 vol. 25, (3/4) 2001 The Haworth Press.

* cited by examiner

*Primary Examiner*—William M. Pierce
(74) *Attorney, Agent, or Firm*—Rankin, Hill, Porter & Clark LLP

(57) ABSTRACT

A memory engagement game is based on Montessori educational principles and employs elements of a trivia game and a bingo game. The game includes a game board having a plurality of openings, a movable cover associated with each opening, a plurality of game cards that can be inserted into the game board, and a plurality of calling cards. Each calling card displays a question, and each game card displays answers to each question. When a game card is inserted into the game board, the answers are in register with the openings. The player can move any given cover to mask the answer displayed in the associated opening. During play, the questions are read aloud and players cover the openings that display the correct answers. Play continues until one or more players covers all of the openings on his game board. The game improves the players' memories while permitting the players to socialize in a non-competitive environment.

20 Claims, 7 Drawing Sheets

MEMORY ENGAGEMENT GAME

GOVERNMENT INTEREST IN THE INVENTION

The present invention was developed with government support under a Small Business Innovation Research Program Grant awarded by the National Institute of Health's National Institute on Aging. The government has certain rights in the invention.

BACKGROUND OF THE INVENTION

1. Field of the Invention

The present invention relates to engaging persons with memory loss and, more particularly, to a game adapted to provide therapy for persons suffering from memory loss.

2. Description of the Prior Art

It is well known that many persons suffer increasing loss of memory with advanced age due to a variety of factors. However, memory loss is limited not only to the elderly, as victims of head injuries, strokes and other illnesses also can suffer memory loss. Memory loss often is frustrating for these individuals, and can lead to a reduction in quality of life and additional health problems. While significant advances in therapy and treatment have been made in recent years, it remains difficult to reverse memory loss, especially memory loss due to advanced age. Many people with memory loss require care in long-term care, assisted living and adult day-care facilities. Activities staff and/or family members try to provide cognitive stimulation through a variety of techniques, such as playing games, making crafts, and providing entertainment, but such efforts often are not effective.

It is believed that the activities with the most therapeutic benefit are those that actively engage the mind, such as solving problems or answering questions, rather than those that passively engage the mind, such as watching television. It further is believed that an environment involving a number of people instead of a solitary environment also is therapeutic. Games that provide mental stimulation and mental engagement, and which provide opportunities for a number of people to interact, are best for persons having memory impairment. While games directed specifically to memory-impaired persons are known, such games have a number of drawbacks.

For example, U.S. Pat. No. 4,244,577 discloses a diagnostic memory skill game that is played by students together with a teacher. The game is played on a game board having player areas. One of the player areas is occupied by the teacher, who plays the game with the students. Individual question cards are read one at a time to each of the players by the teacher. If the question is answered correctly, the question card is placed in a "mastered" area. If the question is answered incorrectly, the question card is placed in a "recycling" area. The object of the game is for each player to respond correctly to each question so that all of the player's question cards are placed in the mastered area before the teacher's question cards are placed likewise. The student players are motivated by competition with the teacher, while the teacher has an opportunity to diagnose student memory skill deficiencies.

Although the competition engendered by the game according to the '577 patent might be desirable in a student-teacher learning environment, it is extremely undesirable for persons who suffer from memory loss. Moreover, the game presumes that the teacher will be as challenged by the questions as the students. Such a situation would be wholly inappropriate for a game played by persons suffering from memory deficiencies.

U.S. Pat. No. 6,270,077 discloses a non-competitive memory enhancement game. The game according to the '077 patent is played with the assistance of family members, friends, and/or volunteers who coordinate play. The game has a question and answer format that is similar to flash-card games. Questions may relate to general knowledge or may be personalized. Personalized questions are developed by family, friends, and others using the player's personal memorabilia. The questions are provided in the form of a photograph or other pictorial image on one side of a card, and questions and/or comments relating to the picture on the opposite side. A game board has a playing path that is divided into positions identified by subject matter categories. Questions related to a given subject matter are asked based on the player's position on the board. Since the game is not competitive, there is no final goal or winning position on the board. The object of the game is to share memories and to receive a reward after participating for a predetermined period of time or number of plays.

While the game according to the '077 patent is desirable in the sense that it is non-competitive, it may not be enjoyed by certain participants due to the personalized nature of some of the questions. In other words, some participants may not want personal information to be shared in a public environment or they may not want to be informed of others' personal information. In addition, the nature of the board requires the participants to sit together around a table. Such an arrangement of the participants relative to each other may be undesirable in certain circumstances. In addition, the use of a game board limits the number of participants to those who can fit around the board. Yet additionally, the game has the potential to be boring because there is no inherent object to be accomplished.

In view of the drawbacks of the prior art, there remains a need for an effective and enjoyable memory engagement game. Any such game desirably would be non-competitive or largely non-competitive, could be played by individuals or a group of players, would permit players to be arranged in any desired position relative to each other, and would not involve the disclosure of personal information. Any such game desirably could be played by persons of different cognitive levels. Perhaps most importantly, the game would be interesting and entertaining to play and would have an inherent object to be accomplished.

SUMMARY OF THE INVENTION

The present invention provides a new and improved memory engagement game that is based on Montessori educational principles, and which employs elements of a trivia game and a bingo game. In the preferred embodiment, the game according to the invention comprises a plurality of game cards, each of which contains answers to certain pre-determined questions. The invention also includes a plurality of calling cards, each of which contains a pre-determined question on one side and various information on the other side, such as the answer to the question, clues to answer the question, and "talking points" to facilitate a discussion related to the question. The invention preferably includes game boards into which the game cards can be inserted. Each game board has a plurality of openings, each of which has a movable cover associated therewith. When a game card is inserted into the game board, the answers to the pre-determined questions are registered with the openings so that a player can see each of the answers. The player can move any given cover in order to mask the answer displayed in the associated opening.

The game according to the invention can be provided in different levels of difficulty and subject matter. Typical subjects would be Presidents, historical events, famous people, nursery rhymes, and so forth. The game cards can be provided with answers to two or more games slightly out of register with each other. Accordingly, by suitably positioning the game card in the game board, two or more separate games can be played on each side of the game card. If double-sided game cards are provided, each game card can contain four or more separate games.

In use, a game board containing a game card is distributed to each player. An activity leader holds up a calling card with the question displayed to the players. The question is read aloud, either by the leader or one or more of the players. If a player sees the answer to the question in one of the game board openings, the player announces the answer and closes the cover to mask the answer. The steps of asking questions and covering the answers are repeated until one or more players covers all of the openings on the game board, signifying the end of that particular game. By choosing games suited to different cognitive levels, the players will be suitably challenged in an interesting and entertaining manner, and will be able share thoughts and memories with each other in a non-competitive environment.

The foregoing and other features and advantages of the invention are fully described in the specification and claims that follow. The accompanying drawings constitute a part of the specification and illustrate an exemplary embodiment of the invention.

DESCRIPTION OF THE PREFERRED EMBODIMENT

Figure 1A:
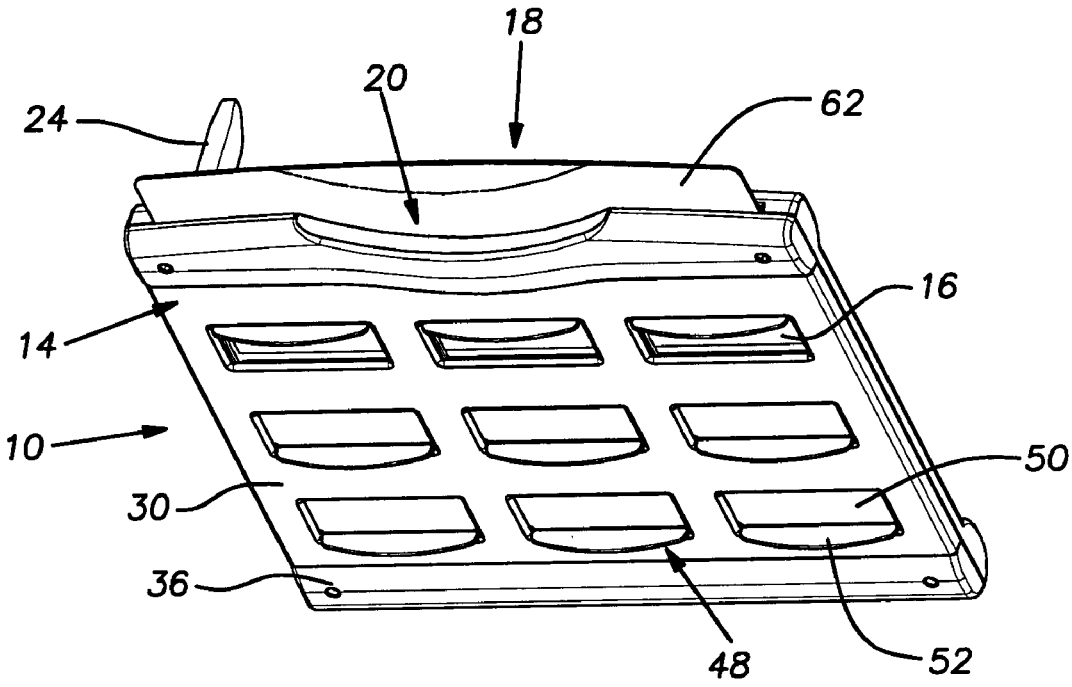
FIGS. 1A and 1B are perspective views of a game board according to the present invention.
Figure 1B:
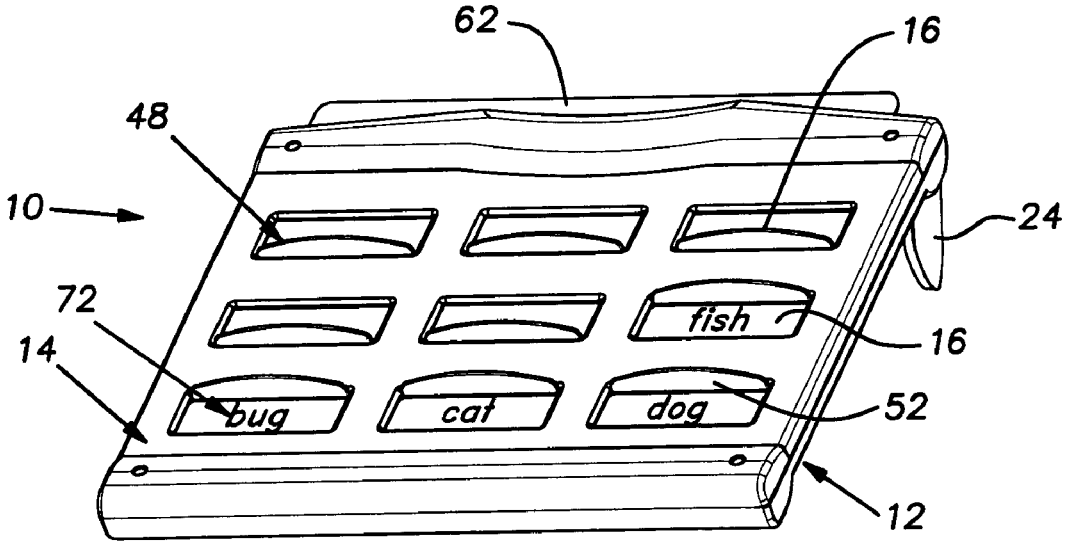

Referring to the various drawing FIGS., apparatus for playing the game according to the invention includes one or more game boards 10, a plurality of game cards 62, and a plurality of calling cards 74. The board 10 has a rear face 12 and a front face 14. The front face 14 has a plurality of openings 16 arranged in a rectangular array in the manner of a bingo game. The board 10 can be placed on any surface for purposes of playing the game, but it preferably will be placed atop a flat playing surface such as a tabletop (not shown).

The front face 14 is secured to the rear face 12, typically by fasteners such as screws. The front face 14 and the rear face 12 are spaced from each other so as to define a cavity 18 therebetween. The game board 10 further includes a slot 20 disposed along one edge of the connected front face 14 and rear face 12. In the preferred embodiment, the game board 10 is rectangular, but it may be shaped differently, if desired.

The rear face 12 is generally planar and includes a peripheral lip 22. The lip 22 extends toward the front face 14. A pair of movable legs 24 are disposed adjacent the upper corners of the rear face 12. The rear face 12 includes a pair of compartments 26 to house the legs 24. The legs 24 may be placed in a first position where the legs 24 are completely disposed within the compartments 26 or in a second position where the legs 24 extend outside the compartments 26. The first position permits the rear face 12 to lie flat upon the playing surface or for storage, and the second position permits the board 10 to be positioned at an angle to the playing surface for improved viewing by players. In the second position, the legs 24 extend from the rear face 12 generally perpendicularly to the rear face 12.

Figure 2:
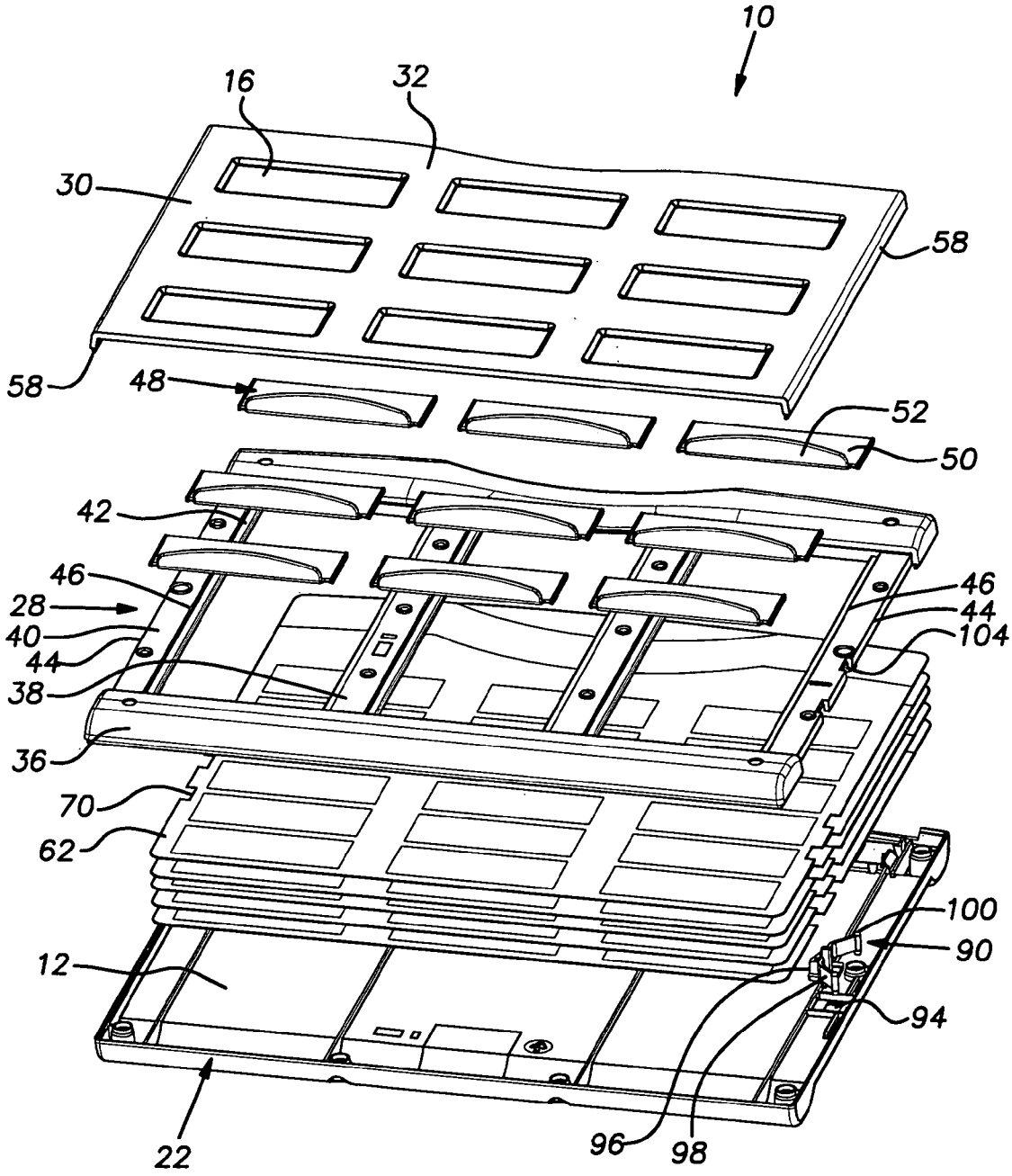
FIG. 2 is an exploded perspective view of the game board according to the present invention.
Figure 3:
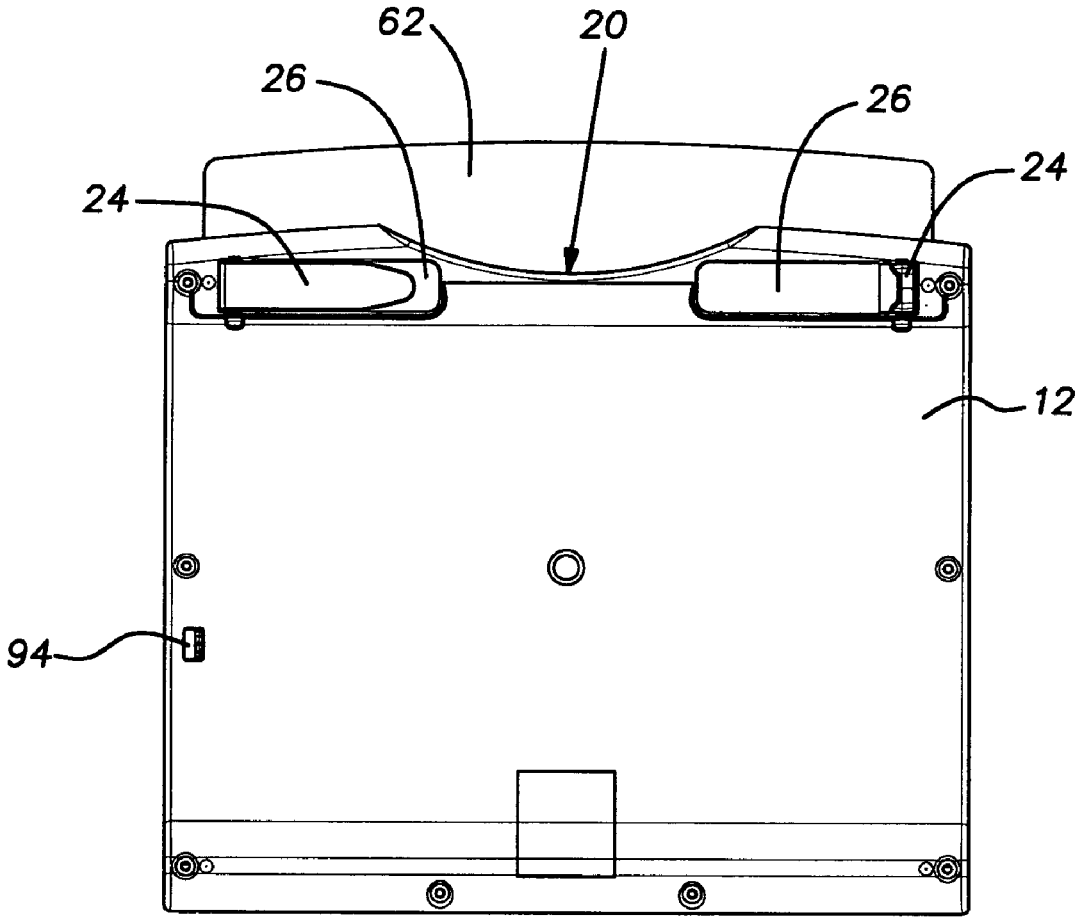
FIG. 3 is a rear elevation view of the game board according to the present invention.
Figure 7:
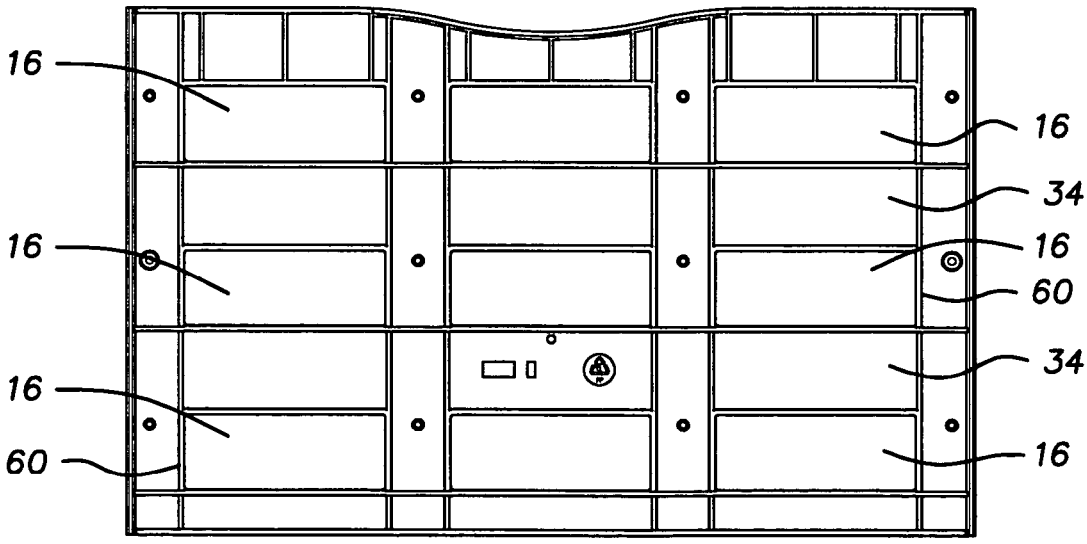
FIG. 7 is an elevation view of the interior face of a front cover of the game board according to the present invention.
Figure 8:
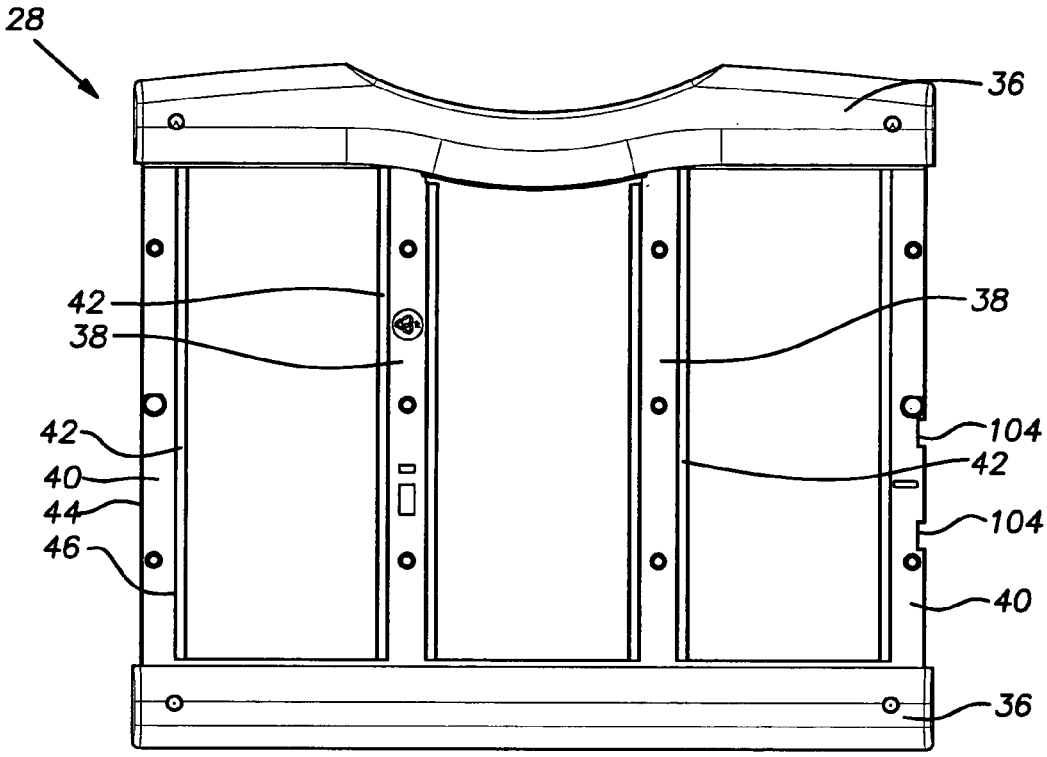
FIG. 8 is a front elevation view of a frame employed with the game board according to the present invention.
Figure 9:
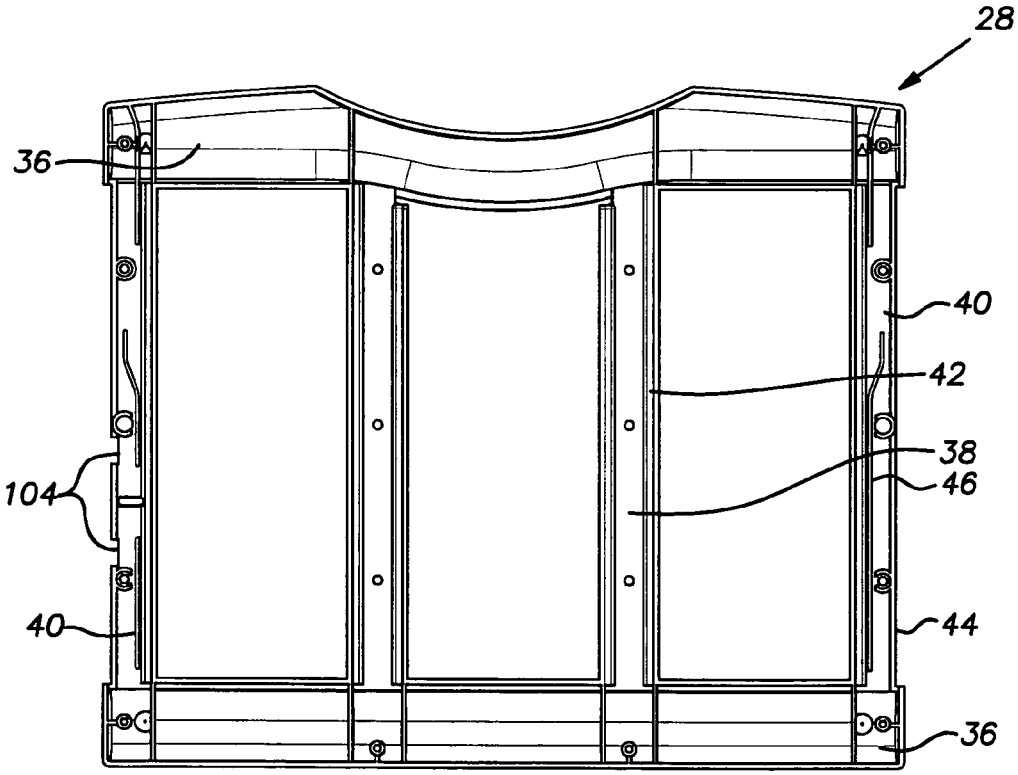
FIG. 9 is a rear elevation view of the frame of FIG. 8.

The front face 14 comprises a frame 28 and a front cover 30. The front cover 30 has an exterior face 32 as illustrated in FIG. 2, and an interior face 34 that is illustrated in FIG. 7. The openings 16 are formed in the front cover 30. The frame 28 has a first side, shown in FIG. 8, and a second side shown in FIG. 9. The frame 28 includes two or more beams 36 that are disposed along opposed edges of the frame 28. The beams 36 are parallel to each other. The frame 28 further includes one or more interior cross-supports 38 and a pair of peripheral cross-supports 40. The cross-supports 38, 40 are parallel to each other and perpendicular to the beams 36. The cross-supports 38, 40 are connected at their ends to the beams 36. The peripheral cross-supports 40 cooperate with the beams 36 to form an outer periphery of the frame 28.

A pair of tracks 42 are disposed along the opposed edges of each interior cross-support 38. The peripheral cross-supports 40 have an outer edge 44 along the outer periphery of the game board 10, and an inner edge 46. A track 42 is disposed along each inner edge 46. As shown in FIG. 2, the beams 36 are thicker than the interior cross-supports 38 and peripheral cross-supports 40. This permits the beams 36 to assist in holding the front cover 30 in place because the front cover 30 is disposed between the beams 36.

The game board 10 includes a plurality of covers 48 that can be positioned to cover or uncover the openings 16. Each cover 48 includes a panel 50 that is substantially planar and generally rectangular. A tab 52 extends outwardly from one edge of the panel 50. A pair of flanges 54 extend outwardly of the panel 50 on opposed sides of the panel 50. The flanges 54 generally define an extension of the panel 50. When viewed from above, the flanges 54 are perpendicular to the tab 52. An enlarged formation 56 is disposed along the outer edge of each flange 54. It is expected that the panels 50 will be opaque, and will have dimensions that approximate that of the openings 16, for example, about 1.3 inches by about 3.4 inches. Preferably, the covers 48 are formed in a molding operation from a colored or dyed plastics material such as clarified polypropylene.

The front cover 30 is substantially planar and fits on top of the interior cross-supports 38 and peripheral cross-supports 40 between the beams 36 on the first side of the frame 28. The front cover 30 includes side edges 58 that extend over the outer edge 44 of the peripheral cross-supports 40. The side edges 58 extend to meet the lip 22 of the rear face 12, thereby defining the outer boundaries of the cavity 18. The interior face 34 of the front cover 30 further includes raised edges 60 (FIG. 7) that border each opening 16. The raised edges 60 are disposed adjacent the tracks 42. During assembly of the game board 10, the front cover 30 is installed so that it rests upon the first side of the frame 28. The tabs 52 of the covers 48 extend outwardly through the openings 16. The tracks 42 and the raised edges 60 engage the flanges 54 so as to compress the flanges 54 therebetween. The tracks 42 and the raised edges 60 fit together in a manner that is tight enough to prevent the covers 48 from moving unless force is applied to the tabs 52 by a player.

Figure 4A:
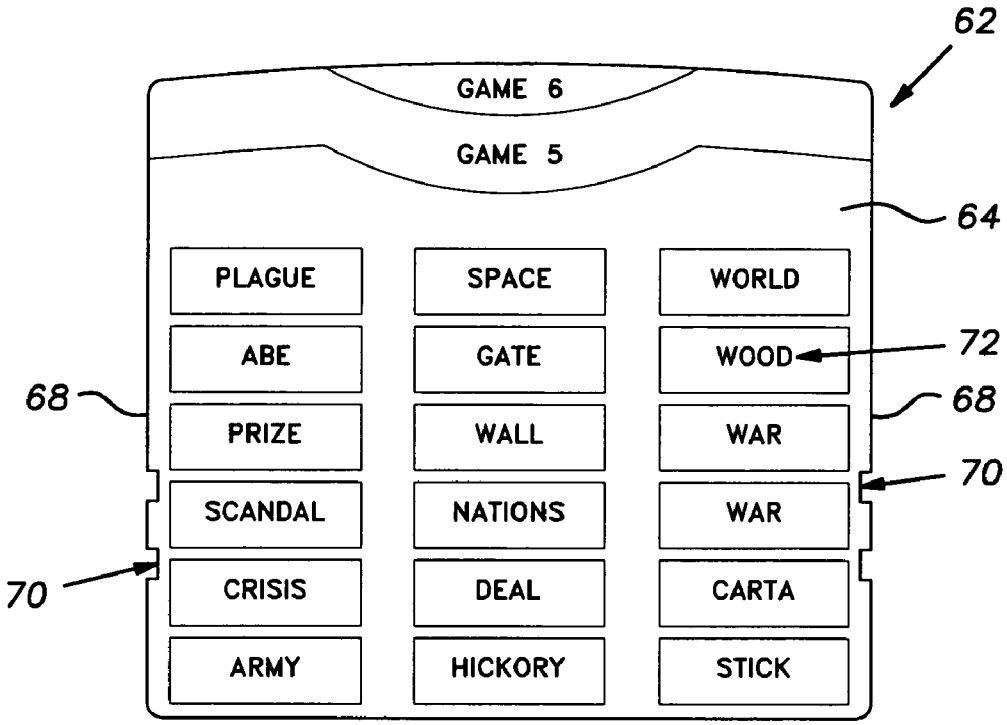
FIGS. 4A and 4B are, respectively, front and rear views of a game card according to the present invention.
Figure 4B:
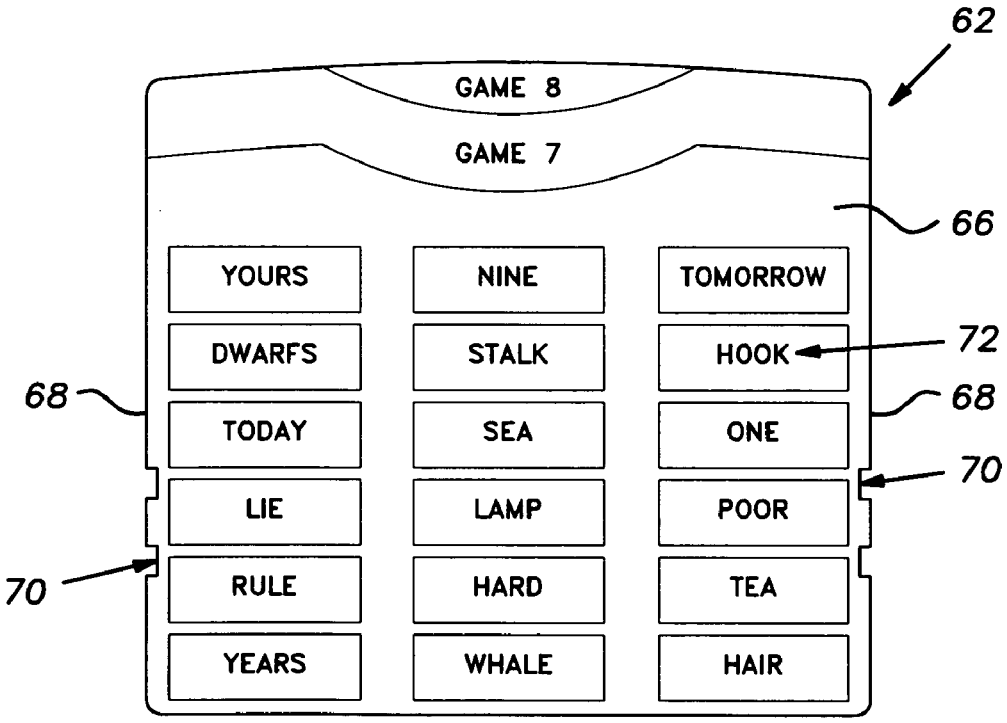

Referring to FIGS. 4A and 4B, game cards 62 according to the invention are illustrated. Each game card 62 has front and rear sides 64, 66 and a pair of opposed side edges 68, each of which includes a pair of notches 70. Each game card 62 has indicia 72 thereon. As will be described in more detail below, the indicia 72 represent answers to pre-determined questions. Preferably, each side 64, 66 includes answers 72 for two games. In use, one or more game cards 62 are inserted through the slot 20 into the cavity 18. The answers 72 for a selected game are visible through the openings 16 when the covers 48 are retracted. If the game card 62 is shifted slightly within the cavity 18, answers 72 corresponding to the other game will be visible through the openings 16.

Figure 5A:
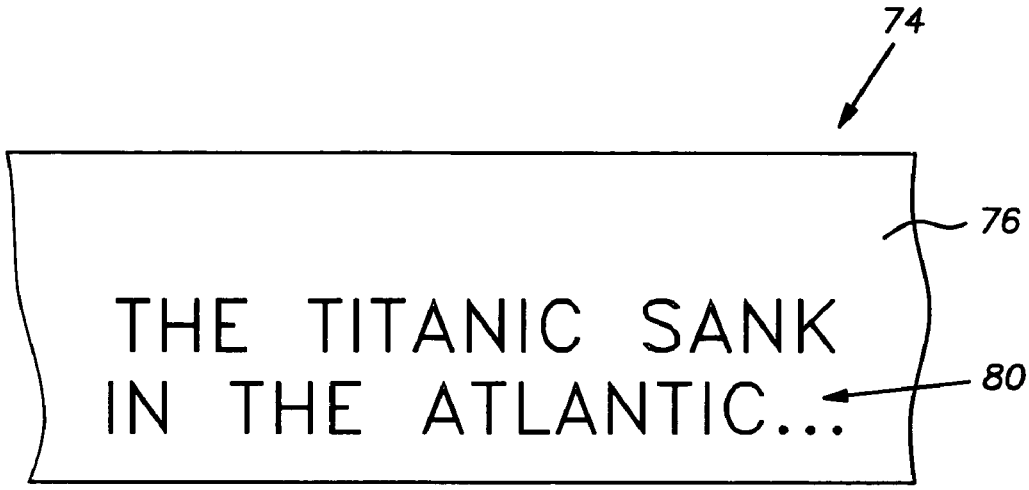
FIGS. 5A and 5B are portions of a calling card according to the present invention.
Figure 5B:
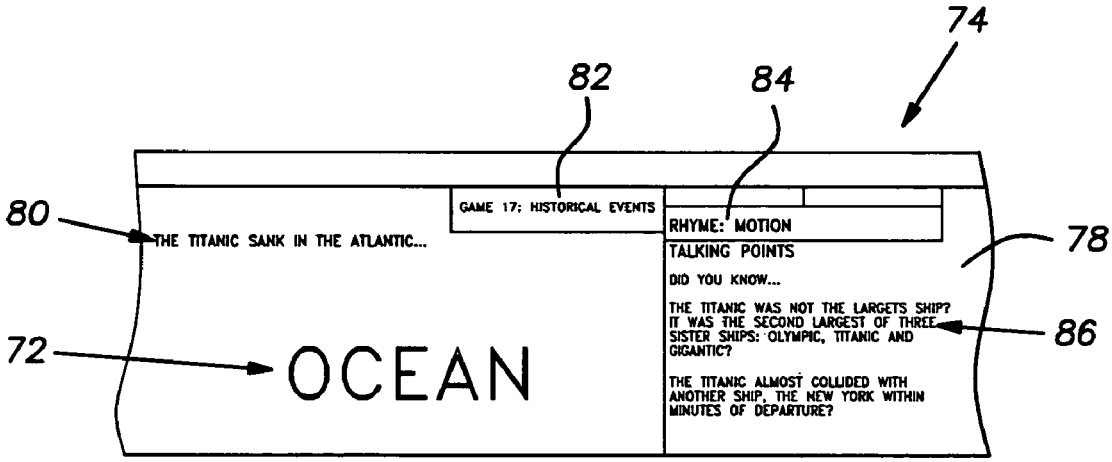
Figure 6A:
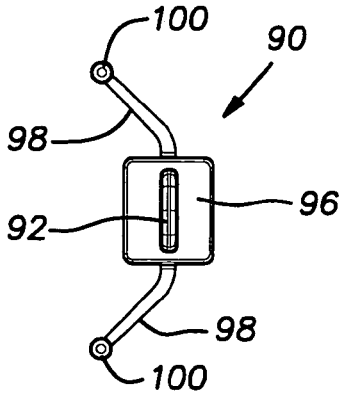
FIGS. 6A, 6B, and 6C are, respectively, a bottom view, a top perspective view, and a bottom perspective view of a release used with the game board according to the present invention to adjust the position of game cards within the game board.
Figure 6B:
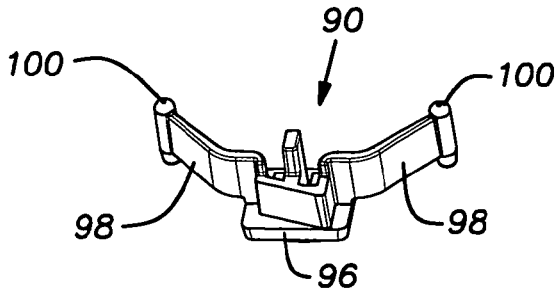
Figure 6C:
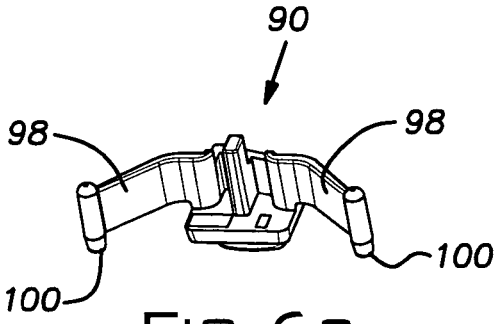
Figure 10:
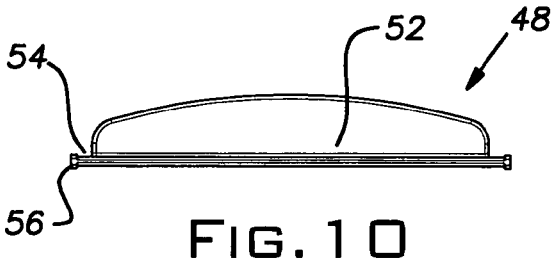
FIG. 10 is an end view of a cover used with the game board according to the present invention.

Referring to FIGS. 5A and 5B, calling cards 74 according to the invention are illustrated. Each calling card 74 has two sides 76, 78. Indicia 80 in the form of a question is displayed on the side 76. The question 80 preferably is a "fill-in-the-blank" question where a player is asked to complete a sentence. The answers 72 on each game card 62 correspond to and provide answers to the questions 80 displayed on the sides 76. The other side of each calling card 74 displays information for an activity leader. The information for the activity leader includes the question 80, the answer 72 to the question 80, the game number and description of the category (indicated by the reference numeral 82), a clue 84 that rhymes with the answer 72 to the question 80, and one or more talking points 86. The talking points 86 are intended to facilitate discussion among the players. The talking points 86 relate to facts about the question 80 and the answer 72.

The game board 10 is provided with a release 90 that locates the game cards 62 in a desired position within the cavity 18. As illustrated in FIGS. 2 and 6A–6C, the release 90 includes a button 92 that extends through an aperture 94 in the rear face 12. The release 90 additionally includes a holder 96 disposed adjacent the button 92, and a pair of deformable wings 98. Each wing 98 terminates in a cylindrical end 100. The ends 100 contact the lip 22 of the rear face 12, and provide support for the wings 98 to position the holder 96 in a position that engages the game cards 62. One of the peripheral cross-supports 40 is provided with a pair of notches 104. The ends 100 move along the lip 22 when the button 92 is pressed. The ends 100 extend through the frame 28, and the notches 104 provide room for unrestricted movement of the ends 100. The holder 96 fits into one of the notches 70 and prevents the game card(s) 62 from sliding within the cavity 18.

To operate the release 90 and remove a game card 62 (or move it to another position), pressure is applied to the button 92. Movement of the button 92 causes the wings 98 to bend, thereby moving the holder 96 in a direction away from the game card 62 and disengaging the notch 70. After the holder 96 has been disengaged from the notch 70, the card 62 can be moved.

The use of slidable covers 48 is an example of one technique for selectively covering and uncovering the openings 16. Other techniques also may be employed. For example, the cover 48 could be hinged such that the cover 48 could be lifted to uncover the associated opening 16, or lowered to cover the opening 16. The cover 48 could be removable. Such a removable cover 48 would be sized to fit the opening 16, and would have a slight interference fit with the openings 16 to hold the cover 48 in place. The removable cover 48 would include a handle or other gripping means for a player to maneuver the cover 48. Magnets also may be used to secure the covers 48 in place. The above-described alternate techniques for covering and uncovering the openings 16 are examples only, and other suitable techniques for selectively covering and uncovering the openings 16 will be apparent to those skilled in the art.

It is preferred that the openings 16 will be large enough to print the answers 72 in large font. A font size of 36 or larger is preferred, and a plain font such as a sans-serif style also is preferred. Additionally, the tabs 52 are sized so that they may be gripped by persons with difficulties resulting from diminished motor skills or arthritis. The game board 10 typically could have dimensions of approximately 11.4 inches by 13.2 inches. The answers 72 are arranged on the game card 62 so that when the game board 10 is inclined at an angle of approximately 15 degrees above the playing surface, the answers 72 appear to be centered in the openings 16.

The game board 10 preferably is formed from a sturdy, lightweight plastics material. The front face 14 and the rear face 12 preferably are opaque and may be colored in a neutral color. The covers 48 may be translucent or opaque and preferably will have a color that contrasts with the color of the front face 14 and rear face 12 to aid players in locating the covers 48. Most color schemes are suitable for the front face 14, the rear face 12, and the covers 48; however, it is preferred that the color scheme does not include fluorescent colors or colors that contrast in a vivid manner. In one preferred embodiment, the front face 14 and the rear face 12 are ivory, and the covers 48 are purple. The game cards 62 and the calling cards 74 preferably are formed from a non-glare cardstock.

The memory engagement game according to the invention may be played in assisted-living adult day care, long-term care, or similar settings. For use in such settings, a game kit preferably includes 15 game boards 10, a plurality of double-sided game cards 62 for each game board 10, a plurality of double-sided calling cards 74 (for example, 15 for each game), and an instruction manual. Each game board 10 has a plurality of openings 16 (preferably nine), and each game card 62 has a plurality of answers 72 (preferably 15) on each side 64, 66, wherein each game card 62 may be used for a plurality of games, preferably four. The game kit thus provides game boards, game cards 62, and calling cards 74 for 15 players. Because the game boards 10 are stand-alone units, there is no limitation on the arrangement of players relative to each other.

Before play begins, each player is provided with a game board 10 and one or more game cards 62. Each side of each game card 62 has displayed thereon the answers 72 for a plurality of games. With reference to the game card 62 illustrated in FIGS. 4A and 4B, each of the two sides 64, 66 of each game card 62 has a plurality of answers 72 printed thereon. The answers 72 preferably are printed so that the printing for each game contrasts with the printing for the other game or games. For example, a game card 62 could display answers 72 for "GAME 5" in white print on a black background, and for "GAME 6," the answers 72 could be displayed in contrasting black print on a white background. The answers 72 are spaced on the game card 62 so that only the answers 72 for a particular game show through the openings 16. For example, when the game card 62 is inserted entirely into the cavity 18, the answers 72 to "GAME 6" may be viewed through the openings 16. When the button 92 is pressed and the game card 62 is moved slightly outwardly from the cavity 18, the answers 72 to "GAME 5" may be viewed through the openings 16.

Each game relates to a particular category 82. Typical game categories 82 include historical events, Presidents, nursery rhymes, and so forth. Each game has a set of game cards 62 and corresponding calling cards 74. If desired, some game cards 62 can contain identical answers 72. In that case, the game will be non-competitive because each of the players will answer the same questions at the same time. It also is possible for the game cards to have different combinations of answers 72. In such a circumstance, the game will be somewhat competitive. For a game having nine answers 72 printed on each game card 62, there preferably are 15 calling cards 74 associated with that game.

To begin play, each player inserts the game card 62 for a selected game into the game board 10. A game leader then reads a question 80 from one of the calling cards 74 that corresponds to that game. If a player determines the answer 72, the player covers the opening 16 in which the answer 72 is displayed. If the players are unable to determine the answer 72, the leader may read a clue 84 displayed on the calling card 74 to assist players in answering the question 80. The leader also may bring up some talking points 86 listed on the calling card 74 to promote discussion among the players. The process of reading questions 80 and covering answers 72 continues until one or more of the players covers all of the openings 16 and indicates to the leader that all of the openings 16 are covered. When a player covers all of the openings 16, it signifies the end of that particular game. The covering of all of the openings 16 thus represents an inherent object to be accomplished by the players. The game card 62 may be moved within the cavity 18 or turned over to reveal the answers 72 that correspond to another game, and the process may be recommenced with a different set of calling cards 74.

To accommodate players having different levels of cognitive functioning, or to speed up play, the play of the game may be modified. For example, play may begin with several of the openings 16 covered. It is possible to provide more difficult questions 80 for higher-functioning players, and simpler questions 80 for players with low-to-mid levels of functioning. The talking points 86 provided on each calling card 74 can be of further therapeutic benefit to players' memory abilities and may be used to extend the game. If it is desired to shorten the game, all or some of the talking points 86 may be omitted.

As will be appreciated from the foregoing description, the game according to the invention is non-competitive or largely non-competitive, can be played by individuals or a group of players, permits players to be arranged in any desired position relative to each other, and does not involve the disclosure of personal information. The game can be played by persons of different cognitive levels or needs. The game is interesting and entertaining to play and has an inherent object to be accomplished.

Although the invention has been shown and described with respect to certain preferred embodiments, equivalent alterations and modifications to the embodiments may be apparent to others skilled in the art upon the reading and understanding of this specification. The present invention is limited only by the scope of the following claims, and includes all such alterations, modifications, and equivalents.

What is claimed is:

1. Game apparatus, comprising:

a game board, the board including:

a front face having a plurality of openings therein;

a rear face connected to the front face, the front and rear faces being spaced from each other so as to define a cavity therebetween; and means for selectively covering and uncovering the openings;

a plurality of calling cards, each calling card displaying information in the nature of a question; and a game card, the game card being of a size and shape to fit within the cavity, wherein the game card has opposed side edges, and at least one side edge has a pair of spaced notches, the game card displaying answers to the questions on the calling cards, the answers being in register with the openings in the front face when the card is disposed in the cavity, the answers being exposed for observation when the openings are uncovered and the answers being shielded from observation when the openings are covered.

2. The apparatus of claim 1, wherein:

a plurality of game cards are provided, the game cards being of the same size and shape; and the cavity is of a size and shape to accommodate the plurality of game cards.

3. The apparatus of claim 1, wherein a plurality of game cards are provided, each game card displaying answers to questions that are related by subject matter.

4. The apparatus of claim 3, wherein each game card has two sides, each side having different answers displayed thereon.

5. The apparatus of claim 1, wherein the game board is used on a playing surface, and further comprising means for supporting the game board at an inclined angle on the playing surface.

6. The apparatus of claim 5, wherein the answers are positioned on each game card such that when the game card is placed within the cavity and the game board is positioned at an inclined angle to the playing surface, the answers will appear to be centered in the openings.

7. The apparatus of claim 5, wherein the means for supporting the game board at an inclined angle to the playing surface includes:

at least one leg pivotally secured to the rear face; and a compartment included as part of the rear face for receiving the leg, the leg being movable from a first position where the leg is completely disposed within the compartment to a second position where the leg extends outside the compartment.

8. The apparatus of claim 1, wherein the front face includes a peripheral frame and a front cover attached to the frame, the front cover being generally of the same shape as the frame, the openings being formed in the front cover.

9. The apparatus of claim 8, wherein the frame further includes:

a pair of beams that are disposed along opposed edges of the frame, the beams being generally parallel with each other;

a pair of peripheral cross-supports that are disposed along opposed edges of the frame and generally perpendicular to the beams, the peripheral cross supports being connected at their ends to the beams, each peripheral cross-support having an inner edge and an outer edge;

a plurality of interior cross-supports that are disposed between the opposed edges of the frame and generally perpendicular to the beams, the interior cross supports being connected at their ends to the beams, each interior cross support having two opposed edges;

a track disposed along the inner edge of each peripheral cross-support; and a track disposed along each edge of each interior cross-support.

10. The apparatus of claim 9, wherein the front cover includes:

an interior face, the interior face having raised edges that in use are disposed adjacent to the tracks.

11. The apparatus of claim 10 wherein the means for selectively covering and uncovering the openings is in the form of a slidable cover that includes:

a panel;

a tab projecting outwardly from of the panel; and a pair of flanges that extend outwardly from the panel, the flanges in use being disposed between the opposed tracks and raised edges.

12. The apparatus of claim 1, wherein each side edge has a pair of spaced notches, and the game card has two spaced sets of answers displayed thereon, and further comprising a release included as part of the game board, the release engaging a selected notch to secure the game card within the cavity in a desired position relative to the openings such that a selected set of answers appears in the openings.

13. The apparatus of claim 1, wherein the front face is colored, the means for selectively covering and uncovering the openings is colored, and the color of the front face is different than the color of the means for selectively covering and uncovering the openings.

14. The apparatus of claim 1, wherein the openings are arranged in a rectangular array.

15. The apparatus of claim 1, wherein each calling card further includes the answer to the question, a clue related to the answer, and one or more talking points related to the question.

16. Game apparatus for improving a person's memory and adapted for use in a group setting, comprising:

a plurality of game boards for use on a playing surface, each board including:

a front face having a plurality of openings therein, the openings being arranged in a rectangular array, the front face including a peripheral frame and a front cover attached to the frame, the front cover being generally of the same shape as the frame, the openings being formed in the front cover;

a rear face of approximately the same size and shape as the front face and connected thereto, the front and rear faces being spaced from each other so as to define a cavity therebetween;

a slot along one edge of the connected front and rear faces that permits access to the cavity;

the frame further including a pair of beams that are disposed along opposed edges of the frame, the beams being generally parallel with each other, a pair of peripheral cross-supports that are disposed along opposed edges of the frame and generally perpendicular to the beams, the peripheral cross supports being connected at their ends to the beams, each peripheral cross-support having an inner edge and an outer edge, a plurality of interior cross-supports that are disposed between the opposed edges of the frame and generally perpendicular to the beams, the interior cross supports being connected at their ends to the beams, each interior cross support having two opposed edges, a track disposed along the inner edge of each peripheral cross-support, and a track disposed along each edge of each interior cross-support;

the front cover further including an interior face, the interior face having raised edges that in use are disposed adjacent to the tracks; and covers for selectively covering and uncovering the openings, each cover being slidable and including a panel, a tab projecting outwardly from of the panel, and a pair of flanges that extend outwardly from the panel, the flanges in use being disposed between the opposed tracks and raised edges;

a plurality of calling cards, each calling card displaying information in the nature of a question;

a plurality of game cards of the same size and shape and being capable of being disposed within the cavity, the game cards displaying answers to the questions on the calling cards and being related by subject matter, each game card having two sides with each side having different answers displayed thereon, the answers being in register with the openings in the front face when the cards are inserted in the cavity, the answers being exposed for observation when the openings are uncovered and the answers being shielded from observation when the openings are covered, each game card having opposed side edges, each side edge has a pair of spaced notches, and the game card has two spaced sets of answers displayed thereon; and a release included as part of the game board, the release engaging a selected notch to secure the game cards within the cavity in a desired position relative to the openings such that a selected set of answers appears in the openings.

17. The apparatus of claim 16, further comprising at least one leg pivotally secured to the rear face and a compartment included as part of the rear face for receiving the leg, the leg being movable from a first position where the leg is completely disposed within the compartment to a second position where the leg extends outside the compartment and supports the game board at an inclined angle to the playing surface, and wherein the answers displayed on each game card are positioned such that when the game card is placed within the cavity and the game board is positioned at an inclined angle to the playing surface, the answers will appear to be centered in the openings.

18. The apparatus of claim 16, wherein the questions are fill-in-the-blank questions and each calling card displays the answer to the question, a clue related to the answer, and one or more talking points related to the question.

19. A method for engaging a person suffering from memory loss, comprising the steps of:

providing a game board, the board including a front face having a plurality of openings therein, a rear face connected to the front face, the front and rear faces being spaced from each other so as to define a cavity therebetween, and means for selectively covering and uncovering the openings;

providing a plurality of calling cards, each calling card displaying information in the nature of a question;

providing a game card having answers to the questions displayed on the calling cards;

inserting a game card into the cavity of each game board so that the answers are displayed in the openings;

reading a question displayed on a selected calling card;

reading at least one talking point to facilitate a discussion among the players, to provide further therapeutic benefit to memory abilities of the players;

covering the opening that displays the answer to the question that has been read; and continuing to read questions and cover openings until all of the openings on the game board are covered.

20. The method of claim 19, wherein the questions are fill-in-the-blank questions and each calling card displays a question, an answer to the question, a clue related to the answer, and the at least one talking point related to the question, wherein the at least one talking point relates to facts about the question and the answer.

* * * * *